US008430075B2

(12) United States Patent
Qiao et al.

(10) Patent No.: US 8,430,075 B2
(45) Date of Patent: Apr. 30, 2013

(54) SUPERAUSTENITIC STAINLESS STEEL AND METHOD OF MAKING AND USE THEREOF

(75) Inventors: Cong Yue Qiao, Menominee, MI (US); Todd Trudeau, Menominee, MI (US)

(73) Assignee: L.E. Jones Company, Menominee, MI (US)

( * ) Notice: Subject to any disclaimer, the term of this patent is extended or adjusted under 35 U.S.C. 154(b) by 1169 days.

(21) Appl. No.: 12/335,825

(22) Filed: Dec. 16, 2008

(65) Prior Publication Data

US 2010/0147247 A1 Jun. 17, 2010

(51) Int. Cl.
*F01L 3/02* (2006.01)

(52) U.S. Cl.
USPC ..... 123/188.8; 123/188.3; 29/888.44; 148/325; 420/40; 420/43; 420/53; 420/64

(58) Field of Classification Search ..... 415/200, 415/216.1; 420/40, 41, 584.1, 585, 84, 448; 123/188.3, 188.8; 29/888.44
See application file for complete search history.

(56) References Cited

U.S. PATENT DOCUMENTS

| | | | | |
|---|---|---|---|---|
| 1,389,133 | A | | 8/1921 | Glekler |
| 1,790,177 | A | | 1/1931 | Stoody |
| 1,984,636 | A | | 12/1934 | Fahrenwald |
| 2,353,688 | A | | 7/1944 | Burgess |
| 2,773,761 | A | | 12/1956 | Fuqua et al. |
| 2,827,373 | A | * | 3/1958 | Prasse et al. ..... 420/585 |
| 3,690,958 | A | | 9/1972 | Thompson |
| 3,834,950 | A | | 9/1974 | Feltz |
| 3,969,109 | A | | 7/1976 | Tanczyn |
| 4,043,844 | A | | 8/1977 | Feltz |
| 4,078,920 | A | | 3/1978 | Liljas et al. |
| 4,080,198 | A | | 3/1978 | Heyer et al. |
| 4,086,107 | A | | 4/1978 | Tanino et al. |
| 4,141,762 | A | | 2/1979 | Yamaguchi et al. |
| 4,162,930 | A | | 7/1979 | Abe et al. |
| 4,200,457 | A | | 4/1980 | Cape |
| 4,222,773 | A | | 9/1980 | Degerbeck |
| 4,398,951 | A | | 8/1983 | Wallwork |
| 4,487,630 | A | | 12/1984 | Crook et al. |

(Continued)

FOREIGN PATENT DOCUMENTS

| | | |
|---|---|---|
| DE | 19512044 | 11/1995 |
| EP | 657556 | 6/1995 |

(Continued)

OTHER PUBLICATIONS

International Search Report and Written Opinion mailed Jul. 15, 2010 for PCT/US2009/006424.

*Primary Examiner* — Noah Kamen
(74) *Attorney, Agent, or Firm* — Buchanan Ingersoll & Rooney PC

(57) ABSTRACT

A superaustenitic stainless steel comprises in weight %, 0.15 to 0.9% C, 0.2 to 1.3% Si, 0 to 0.45% Mn, 32.5 to 37.5% Cr, 13.5 to 17.5% Ni, 3.2 to 5.5% Mo, 0 to 2% Nb, 0 to 0.5% B, 0 to 2% Zr and 30 to 51% Fe. In a preferred embodiment, the superaustenitic stainless steel consists essentially of, in weight %, 0.5 to 0.9% C, 0.2 to 0.5% Si, 0.2 to 0.4% Mn, 33.0 to 35.0% Cr, 15.5 to 17.5% Ni, 4.0 to 4.5% Mo, 0.7 to 0.9% Nb, 0.07 to 0.13% B, 0 to 0.05% Zr and 40 to 46% Fe. The superaustenitic stainless steel is useful for valve seat inserts for internal combustion engines such as diesel or natural gas engines.

22 Claims, 3 Drawing Sheets

U.S. PATENT DOCUMENTS 4,487,744 A 12/1984 DeBold et al.
4,494,998 A 1/1985 Ueda et al.
4,536,232 A 8/1985 Khandros et al.
4,572,738 A 2/1986 Korenko et al.
4,689,198 A 8/1987 Fujiwara et al.
4,724,000 A 2/1988 Larson et al.
4,735,771 A 4/1988 Corwin
4,740,353 A 4/1988 Cogan et al.
4,765,836 A 8/1988 Hauser et al.
4,767,456 A 8/1988 Spitzer
4,803,045 A 2/1989 Ohriner et al.
4,863,515 A 9/1989 Roberts et al.
4,873,055 A 10/1989 Culling
4,999,159 A 3/1991 Uematsu et al.
5,194,220 A 3/1993 Takahashi et al.
5,194,221 A 3/1993 Culling
5,252,149 A 10/1993 Dolman
5,320,801 A 6/1994 Culling
5,360,592 A 11/1994 Culling
5,433,744 A 7/1995 Breyen et al.
5,480,609 A 1/1996 Dupoiron et al.
5,494,636 A 2/1996 Dupoiron et al.
5,501,835 A 3/1996 Watanabe et al.
5,674,449 A 10/1997 Liang et al.
5,695,716 A 12/1997 Kohler et al.
5,702,668 A 12/1997 Ocken et al.
5,714,115 A 2/1998 Speidel et al.
5,827,476 A 10/1998 Linden et al.
5,961,284 A * 10/1999 Kuriyama et al. ..... 415/200
6,033,626 A 3/2000 Takahashi
6,245,289 B1 6/2001 Dodd
6,273,968 B1 8/2001 Thomas
6,383,310 B1 5/2002 Otsuka et al.
6,436,338 B1 8/2002 Qiao
6,482,275 B1 11/2002 Qiao
6,485,678 B1 11/2002 Liang et al.
6,576,068 B2 6/2003 Grubb et al.
6,702,905 B1 3/2004 Qiao et al.
6,709,528 B1 3/2004 Grubb et al.
6,761,777 B1 7/2004 Radon
6,764,555 B2 7/2004 Hiramatsu et al.
6,767,416 B2 7/2004 Ishibashi et al.
6,866,816 B2 3/2005 Liang et al.
6,881,280 B2 4/2005 Qiao
6,908,589 B2 6/2005 Kitudo et al.
6,916,444 B1 7/2005 Liang
6,918,967 B2 7/2005 Crum et al.
6,926,778 B2 8/2005 Iseda et al.
6,939,415 B2 9/2005 Iseda et al.
7,118,636 B2 10/2006 Chen et al.
7,153,373 B2 12/2006 Maziasz et al.
7,235,212 B2 6/2007 Kuehmann et al.
7,297,177 B2 11/2007 Sandberg et al.
7,361,411 B2 4/2008 Daemen et al.
8,048,369 B2 * 11/2011 Forbes Jones et al. ..... 420/588
2003/0230164 A1 12/2003 Henmi et al.
2004/0033154 A1 2/2004 Liang et al.
2005/0252338 A1 11/2005 Henmi et al.
2006/0034724 A1 2/2006 Hamano et al.
2006/0266439 A1 11/2006 Maziasz et al.
2007/0144622 A1 6/2007 Flahaut
2008/0025866 A1 1/2008 Kondoh et al.
2008/0095656 A1 4/2008 Loucif et al.

FOREIGN PATENT DOCUMENTS

EP 1645649 A1 4/2006
JP 54-096418 7/1979
JP 61052351 A 3/1986
JP 2000297329 A 10/2000
WO WO2005103314 A1 11/2005
WO WO 2008/005243 A2 1/2008

* cited by examiner

SUPERAUSTENITIC STAINLESS STEEL AND METHOD OF MAKING AND USE THEREOF

BACKGROUND

More restrictive exhaust emissions laws for diesel and natural gas engines and high power output for internal combustion engines have driven changes in engine design including the need for high-pressure electronic fuel injection systems in diesel engines and stoichiometric combustion in natural gas engines. Engines built according to the new designs use higher combustion pressures, higher operating temperatures and less lubrication than previous designs. Components of the new designs, including valve seat inserts (VSI's), have experienced significantly higher wear rates. Intake and exhaust valve seat inserts and valves, for example, must be able to withstand a high number of valve impact events and combustion events with minimal wear (e.g., abrasive, adhesive, and corrosive wear). This has motivated a shift in materials selection toward materials that offer improved wear resistance relative to the valve seat insert materials that have traditionally been used by the diesel and natural gas industry.

Another emerging trend in diesel engine development is the use of EGR (exhaust gas recirculation). With EGR, exhaust gas is routed back into the intake air stream to reduce nitric oxide ($NO_x$) content in exhaust emissions. The use of EGR in diesel or natural gas engines can raise the operating temperatures of valve seat inserts. Accordingly, there is a need for lower cost valve seat inserts having good mechanical properties including hot hardness for use in diesel and natural gas engines using EGR.

Also, because exhaust gas contains compounds of nitrogen, sulfur, chlorine, and other elements that potentially can form acids, the need for improved corrosion resistance for alloys used in valve seat inserts is increased for diesel and natural gas engines using EGR. Acid can attack valve seat inserts and valves leading to premature engine failure.

SUMMARY

A superaustenitic stainless steel comprises in weight %, 0.15 to 0.9% C, 0.2 to 1.3% Si, 0 to 0.45% Mn, 32.5 to 37.5% Cr, 13.5 to 17.5% Ni, 3.2 to 5.5% Mo, 0 to 2% Nb, 0 to 0.5% B, 0 to 2% Zr and 30 to 51% Fe. In a preferred embodiment, the superaustenitic stainless steel consists essentially of, in weight %, 0.5 to 0.9% C, 0.2 to 0.5% Si, 0.2 to 0.4% Mn, 33.0 to 35.0% Cr, 15.5 to 17.5% Ni, 4.0 to 4.5% Mo, 0.7 to 0.9% Nb, 0.07 to 0.13% B, 0 to 0.05% Zr and 40 to 46% Fe.

The superaustenitic stainless steel preferably has a microstructure with an austenitic matrix free of primary carbides, ferrite and/or martensite with strengthening phases distributed along interdendritic or intergranular regions. The intragranular or dendritic regions comprise an austenitic matrix; and the interdendritic regions comprise eutectic reaction phases. The austenitic matrix is rich in Cr; and the eutectic reaction phases are rich in Ni; and/or the austenitic matrix contains precipitates of niobium carbide and/or niobium carbonitride.

The superaustenitic stainless steel alloy described above is useful as a valve seat insert for engine applications such as diesel or gas engines.

The valve seat insert can be a casting with an as-cast hardness from about 35 to about 45 Rockwell C, a compressive yield strength from about 80 ksi to about 100 ksi at about room temperature; and/or a compressive yield strength from about 60 ksi to about 80 ksi at about 1000° F. Preferably, the insert has an ultimate tensile rupture strength from about 50 ksi to about 70 ksi at about room temperature; and/or an ultimate tensile rupture strength from about 40 ksi to about 60 ksi at about 1000° F.; exhibits a dimensional stability of less than about $0.3\times10^{-3}$ inches per inch of insert outside diameter (O.D.) after heating for about 20 hours at about 1200° F. The weight % Mn is present in an amount effective to produce a microstructure free of σ-iron-chromium tetragonal precipitates, martensite phases and/or ferrite phases after about 20 hours at about 1200° F. Preferably, the insert exhibits an HV10 Vickers hardness from about 420 HV10 at about room temperature to about 335 HV10 at about 1000° F.; or a decrease in hardness of 25% or less when heated from about room temperature to about 1000° F.

A method of operating an internal combustion engine is provided. In operating an internal combustion engine such as a diesel or natural gas engine, a valve is closed against the valve seat insert to close a cylinder of the internal combustion engine and the fuel is ignited in the cylinder to operate the internal combustion engine. The valve is preferably composed of a high-chromium iron-based alloy or a high-temperature, nickel-based superalloy; or the valve is hard-faced with a high temperature, wear-resistant alloy strengthened by carbides.

A method of making a superaustenitic stainless steel as described above is provided. The superaustenitic stainless steel can be cast from a melt into a shaped component at a temperature from about 2800° F. to about 3000° F.; or a powder of the superaustenitic stainless steel can be pressed into a shaped component and sintered at a temperature from about 1950° F. to about 2300° F. in a reducing atmosphere. The reducing atmosphere can be hydrogen or a mixture of dissociated ammonia and nitrogen. The shaped component can be a valve seat insert and precipitation hardening heat treated at a temperature from about 900° F. to about 1700° F. for about 2 hours to about 15 hours. The heat treating can be performed in an inert, oxidizing, or reducing atmosphere, or in a vacuum.

DETAILED DESCRIPTION

Figure 1:
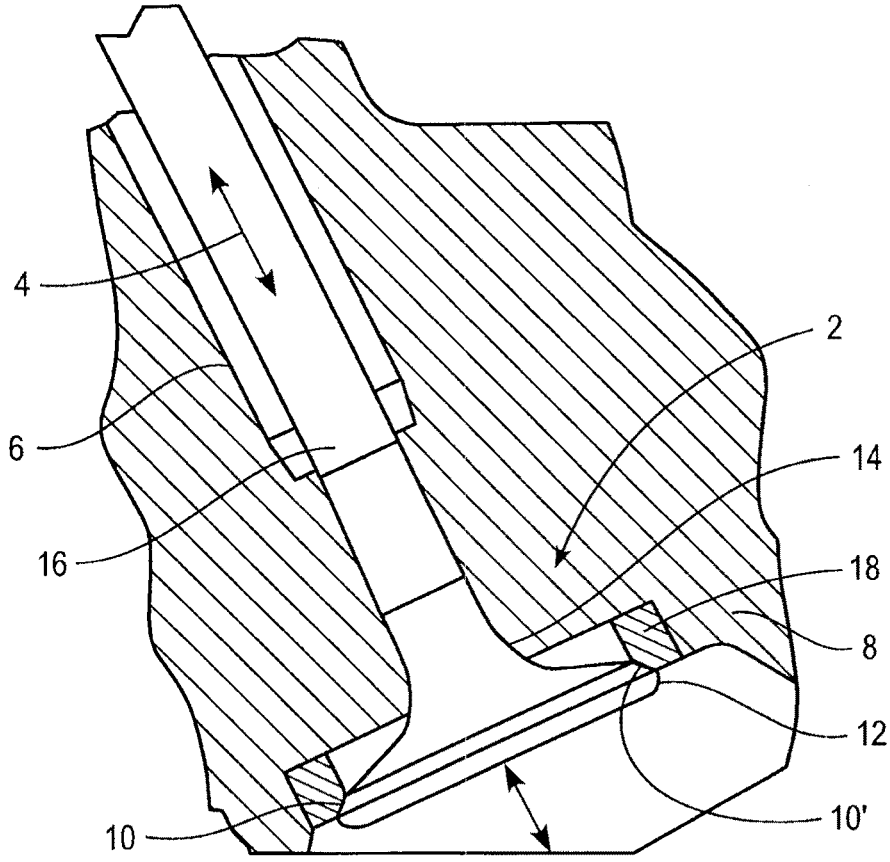
FIG. 1 is a cross-sectional view of a valve assembly incorporating a valve seat insert of a superaustenitic stainless steel (referred to herein as the J109 alloy).

FIG. 1 illustrates an exemplary engine valve assembly 2. Valve assembly 2 includes a valve 4, which is slideably supported within the internal bore of a valve stem guide 6. The valve stem guide 6 is a tubular structure that fits into the cylinder head 8. Arrows illustrate the direction of motion of the valve 4. Valve 4 includes a valve seat face 10 interposed between the cap 12 and neck 14 of the valve 4. Valve stem 16 is positioned above neck 14 and is received within valve stem guide 6. A valve seat insert 18 having a valve seat insert face 10' is mounted, such as by press-fitting, within the cylinder head 8 of the engine. The cylinder head usually comprises a casting of cast iron, aluminum or an aluminum alloy. Preferably, the insert 18 (shown in cross section) is annular in shape and the valve seat insert face 10' engages the valve seat face 10 during movement of valve 4.

While cobalt-based alloys (e.g., STELLITE 3® or TRIBALOY T-400®) and nickel-based alloys (e.g., EATONITE®) have been used for manufacturing valve seat insert 18, due to the high temperature wear resistance and compressive strength of such alloys, a major disadvantage of such alloys is their relatively high cost. Thus, a need exists for a lower cost iron-based alloy with improved corrosion-resistant and improved wear-resistant properties, such as stainless steel, as a replacement for cobalt-based or nickel-based alloys for valve seat insert 18.

In general, the five classifications of engineering stainless steels (i.e., austenitic, ferritic, martensitic, duplex and superaustenitic) possess good corrosion resistance for valve seat insert applications. However, for some classes of stainless steels, high-temperature mechanical properties may be less than satisfactory. Austenitic stainless steels (e.g., AISI-SAE No. 304) exhibit good corrosion resistance, toughness and ductility, but lack high temperature wear resistance. Ferritic stainless steels (e.g., AISI-SAE No. 430) have been modified for internal combustion engine components, however, high-temperature strength has been limited. Martensitic stainless steels (e.g., AISI-SAE No. 410) have also been used for internal combustion engine components, however, its wear-resistance properties are limited under service conditions with high-stress, dry contact and sharp temperature gradients. Although duplex stainless steels (e.g., FERRALIUM® 255) exhibit excellent stress corrosion and cracking resistance, the desired ratio of austenite to ferrite can be difficult to control for certain melting and casting operations (e.g., open air induction furnace melting and shell sand casting).

Superaustenitic stainless steels (e.g., AL6-XN®, available from Allegheny Technologies) possess both significant corrosion resistance and high temperature strength. However, commercially available superaustenitic stainless steels are generally not intended for wear resistant applications. Thus, a superaustenitic stainless steel with enhanced wear resistant properties would be a promising lower cost alternative for cobalt-based or nickel-based alloys for valve seat insert applications.

Disclosed herein is a novel superaustenitic stainless steel (referred to herein as "J109 alloy") for valve-train material applications, preferably internal combustion valve seat inserts. The superaustenitic stainless steel is designed to produce a fully austenitic matrix material free of coarse primary carbides during casting. Strengthening phases in the form of niobium carbides (NbC) and/or niobium carbonitride (NbCN) are distributed along interdendritic or intergranular regions. Because both peritectic and eutectic reactions occur during solidification, shrinkage associated with casting is reduced.

The J109 alloy has improved mechanical properties (i.e., bulk hardness, hot hardness and compressive yield strength) relative to commercially available fully austenitic stainless steel alloys (e.g., AL6-XN®); and improved compressive yield strength over conventional nickel-based alloys. The J109 alloy has a greater hot hardness than a tempered martensitic tool steel (e.g., J120V, available from L.E. Jones Company) at temperatures greater than 1000° F. Additionally, the J109 alloy has excellent wear resistance when paired with a nickel-based valve material (e.g., INCONEL-751®, a high-temperature, nickel-based superalloy) and a high-chromium iron-based valve alloy (e.g., Alloy C or CROMO-193). Thus, the J109 alloy is a low cost alternative to cobalt-based or nickel-based alloys used as valve seat insert materials.

The superaustenitic stainless steel (J109 alloy) comprises, in weight %, 0.15 to 0.9% C, 0.2 to 1.3% Si, 0 to 0.45% Mn, 32.5 to 37.5% Cr, 13.5 to 17.5% Ni, 3.2 to 5.5% Mo, 0 to 2% Nb, 0 to 0.5% B, 0 to 2% Zr and 30 to 51% Fe. In a preferred embodiment, the valve seat insert consists essentially of, in weight %, 0.5 to 0.9% C, 0.2 to 0.5% Si, 0.2 to 0.4% Mn, 33.0 to 35.0% Cr, 15.5 to 17.5% Ni, 4.0 to 4.5% Mo, 0.7 to 0.9% Nb, 0.07 to 0.13% B, 0 to 0.05% Zr and 40 to 46% Fe.

Evaluation of J109 Alloy

Forty-six trials of J109 experimental heats (i.e., 60 pound lots) were fabricated to evaluate formation of ferrite phases and the effects of alloying elements (e.g., C, Mn, Si, Mo, Nb, N, B, or Zr) on mechanical properties and castability. The casting temperature can range from about 2800° F. to about 3000° F. depending upon the size of the casting. The castings were prepared in an open-air induction furnace. The J109 alloy can be compositionally adjusted to optimize bulk hardness and strength. This data is summarized in TABLES 1-11. Bulk hardness was characterized by Rockwell hardness tests, scale C (i.e., HRC).

In Trials 1 and 2, a target 6Ni-24Cr-3.2Mo alloy was cast, similar to the composition of superaustenitic stainless steel AL6-XN®. For Trials 1 and 2, the carbon content was about 0.82 weight % and about 1 weight %, respectively. The hardness values varied from about 25.9 HRC to about 33.1 HRC. However, for valve seat inserts, a hardness from about 35 HRC to about 45 HRC is preferable.

In Trials 3 and 4, the influence of increasing carbon content and decreasing manganese and silicon content for the 6Ni-24Cr-3.2Mo alloy was evaluated. In Trials 3 and 4, the carbon content was increased to about 1.17 weight % and 1.22 weight %. For Trials 3 and 4, an increase in hardness values to about 38 HRC was achieved.

In Trials 1-4 a small amount of ferrite was observed in the microstructure of the casting. Ferrite phases are not preferred, due to potential reductions in mechanical properties or corrosion resistance for the alloy. The compositions and measured hardness of Trials 1-4 are summarized in TABLE 1.

TABLE 1

| Trial | Heat | C | Mn | Si | Ni | Cr | Mo | Nb | Fe | N | B | Zr | HRC |
|---|---|---|---|---|---|---|---|---|---|---|---|---|---|
| 1 | 5J18XA | 0.820 | 0.812 | 0.588 | 6.036 | 23.63 | 3.233 | 0.028 | 64.53 | 0.025 | 0.002 | 0.010 | 25.9 |
| 2 | 5J25XA | 1.082 | 0.780 | 0.715 | 5.932 | 24.45 | 3.376 | 0.032 | 63.30 | 0.042 | 0.002 | 0.010 | 33.1 |
| 3 | 5K01XA | 1.176 | 0.688 | 0.823 | 5.41 | 26.23 | 3.207 | 0.009 | 62.23 | 0.055 | 0.002 | 0.009 | 38.2 |
| 4 | 5K10XA | 1.221 | 0.650 | 1.273 | 4.83 | 27.71 | 3.424 | 0.034 | 60.36 | 0.055 | 0.002 | 0.009 | 38.7 |

In Trials 5-8, the influence of varying nickel content from about 9 weight % to about 17 weight % and increasing chromium content to about 36-38 weight % was evaluated. For Trials 5-8, the hardness values ranged from about 37.4 HRC to about 58.7 HRC. For Trial 7, a high hardness value of about 58.7 HRC indicated the presence of martensite, a phase exhibiting poor corrosion resistance and poor dimensional stability. From Trial 8, it was determined that slight variations in an alloy composition of about 16Ni-38Cr-3.8Mo would produce hardness of about 45 HRC. The compositions and measured hardness of Trials 5-8 are summarized in TABLE 2.

TABLE 2

| Trial | Heat | C | Mn | Si | Ni | Cr | Mo | Nb | Fe | N | B | Zr | HRC |
|---|---|---|---|---|---|---|---|---|---|---|---|---|---|
| 5 | 5L21XA | 0.108 | 0.101 | 1.141 | 17.15 | 38.18 | 3.482 | 0.053 | 39.34 | 0.157 | 0.002 | 0.011 | 54.8 |
| 6 | 6A18XA | 0.046 | 0.169 | 1.072 | 9.00 | 37.25 | 3.567 | 0.043 | 48.55 | 0.085 | 0.002 | 0.011 | 37.4 |
| 7 | 6A19XA | 0.057 | 0.282 | 1.042 | 10.37 | 36.97 | 3.668 | 0.041 | 47.25 | 0.074 | 0.003 | 0.013 | 58.7 |
| 8 | 6B21XA | 0.035 | 0.116 | 1.294 | 16.22 | 38.09 | 3.817 | 0.050 | 39.95 | 0.147 | 0.023 | 0.012 | 54.9 |

In Trials 9-12, the effects of silicon and molybdenum content for an alloy with a target 35Cr-16Ni content were evaluated. Silicon content was varied from about 0.21 weight % to about 0.69 weight %; molybdenum content was varied from about 0.05 weight % to about 3.9 weight %. The compositions and measured hardness of Trials 9-12 are summarized in TABLE 3.

TABLE 3

| Trial | Heat | C | Mn | Si | Ni | Cr | Mo | Nb | Fe | N | B | Zr | HRC |
|---|---|---|---|---|---|---|---|---|---|---|---|---|---|
| 9 | 6B28XA | 0.484 | 0.098 | 0.690 | 15.75 | 33.72 | 3.910 | 0.042 | 45.04 | 0.058 | 0.003 | 0.011 | 30.6 |
| 10 | 6C07XA | 0.551 | 0.144 | 0.528 | 16.46 | 32.75 | 3.305 | 0.046 | 45.76 | 0.093 | 0.002 | 0.011 | 28.8 |
| 11 | 6C09XA | 0.490 | 0.175 | 0.447 | 15.66 | 32.73 | 0.048 | 0.044 | 50.05 | 0.081 | 0.001 | 0.012 | 16.6 |
| 12 | 6C09XB | 0.454 | 0.165 | 0.216 | 16.00 | 32.50 | 3.553 | 0.052 | 46.66 | 0.087 | 0.002 | 0.012 | 28.2 |

Trials 9-12 illustrate that the hardness of the alloy is strongly influenced by the molybdenum content. As seen in TABLE 3, an increase in molybdenum from about 0.5 weight % to about 3.9 weight % results in an increase in hardness from about 16.6 HRC to about 30.6 HRC.

In Trials 13-16, the effects of niobium content for an alloy with a target 35Cr-16Ni-4Mo content were evaluated. The compositions and measured hardness of Trials 13-16 are summarized in TABLE 4.

TABLE 4

| Trial | Heat | C | Mn | Si | Ni | Cr | Mo | Nb | Fe | N | B | Zr | HRC |
|---|---|---|---|---|---|---|---|---|---|---|---|---|---|
| 13 | 6C16XA | 0.467 | 0.092 | 0.626 | 16.43 | 35.07 | 3.728 | 0.043 | 43.27 | 0.042 | 0.003 | 0.011 | 38.7 |
| 14 | 6C29XA | 0.614 | 0.130 | 1.156 | 16.42 | 34.80 | 3.476 | 0.047 | 43.01 | 0.088 | 0.002 | 0.011 | 37.5 |
| 15 | 6C29XB | 0.572 | 0.131 | 0.516 | 16.14 | 34.98 | 3.827 | 0.910 | 42.60 | 0.052 | 0.002 | 0.013 | 44.1 |
| 16 | 6D11XA | 0.501 | 0.115 | 0.943 | 15.78 | 35.02 | 3.960 | 0.846 | 42.55 | 0.031 | 0.003 | 0.014 | 47.5 |

Trials 13-16 illustrate that the hardness of the alloy is also strongly influenced by niobium content. As seen in TABLE 4, increasing niobium from about 0.4 weight % to about 0.9 weight % results in an increase in hardness from about 38.7 HRC to about 44.1 HRC.

In Trials 17-20, the effects of increased carbon content (about 0.3 weight % to 0.4 weight %) in combination with two different manganese contents for an alloy with a target 35Cr-16Ni-4Mo content were evaluated. The compositions and measured hardness of Trials 17-20 are summarized in TABLE 5.

TABLE 5

| Trial | Heat | C | Mn | Si | Ni | Cr | Mo | Nb | Fe | N | B | Zr | HRC |
|---|---|---|---|---|---|---|---|---|---|---|---|---|---|
| 17 | 6D27XA | 0.393 | 0.076 | 0.388 | 15.73 | 35.64 | 4.003 | 0.883 | 42.61 | 0.043 | 0.001 | 0.013 | 44.0 |
| 18 | 6D27XB | 0.417 | 0.075 | 0.405 | 15.77 | 35.99 | 3.888 | 0.914 | 42.24 | 0.072 | 0.001 | 0.013 | 42.6 |
| 19 | 6E15XA | 0.320 | 0.095 | 0.335 | 15.68 | 36.00 | 3.941 | 0.772 | 42.55 | 0.062 | 0.001 | 0.013 | 43.0 |
| 20 | 6E16XA | 0.312 | 0.104 | 0.420 | 16.04 | 35.86 | 4.068 | 0.917 | 41.99 | 0.048 | 0.001 | 0.014 | 44.8 |

Trials 17-20 illustrate that for low carbon content, the effects of about 1 weight % manganese in comparison to about 0.75% manganese produced little difference in hardness of the alloy, which varied from 42.6 HRC to 44.8 HRC.

In Trials 21-23, the effects of slightly elevated carbon content (about 0.5 weight %) and silicon content (about 0.5 weight %) for an alloy with a target 35Cr-16Ni-4Mo content were evaluated, in comparison to Trials 17-20 (TABLE 5). The compositions and measured hardness of Trials 21-23 are summarized in TABLE 6.

TABLE 6

| Trial | Heat | C | Mn | Si | Ni | Cr | Mo | Nb | Fe | N | B | Zr | HRC |
|---|---|---|---|---|---|---|---|---|---|---|---|---|---|
| 21 | 6E17XA | 0.409 | 0.074 | 0.501 | 15.63 | 35.30 | 4.041 | 0.796 | 42.93 | 0.073 | 0.001 | 0.014 | 40.1 |
| 22 | 6E17XB | 0.421 | 0.081 | 0.490 | 15.59 | 35.60 | 3.866 | 0.863 | 42.79 | 0.071 | 0.001 | 0.014 | 41.7 |
| 23 | 6E26XA | 0.577 | 0.096 | 0.534 | 15.51 | 35.46 | 4.110 | 0.990 | 41.30 | 0.150 | 0.002 | 0.015 | 37.7 |

Trials 21-22 illustrate that slightly higher carbon and silicon content has a minimal effect on bulk hardness, which varied from 37.7 HRC to 41.7 HRC. As a comparison, from Trials 17-20, bulk hardness varied from 42.6 HRC to 44.8 HRC.

In Trials 24-26, the effects of zirconium and elevated nickel (up to 18 weight %) for an alloy with a target 35Cr-4Mo content were evaluated. The compositions and measured hardness of Trials 24-26 are summarized in TABLE 7.

TABLE 7

| Trial | Heat | C | Mn | Si | Ni | Cr | Mo | Nb | Fe | N | B | Zr | HRC |
|---|---|---|---|---|---|---|---|---|---|---|---|---|---|
| 24 | 6E26XB | 0.445 | 0.139 | 0.626 | 18.02 | 31.16 | 4.426 | 0.696 | 43.83 | 0.090 | 0.002 | 0.192 | 25.7 |
| 25 | 6E31XA | 0.462 | 0.106 | 1.063 | 17.22 | 36.71 | 3.982 | 0.533 | 38.78 | 0.032 | 0.004 | >0.276 | 54.9 |
| 26 | 6F05XA | 0.367 | 0.116 | 0.517 | 16.56 | 36.09 | 4.405 | 0.441 | 40.27 | 0.023 | 0.002 | >0.276 | 57.3 |

Trials 24-26 illustrate that up to 0.3 weight % zirconium exhibited a significant increase in bulk hardness. The bulk hardness varied from 54.9 HRC to 57.3 HRC. However, elevated zirconium content compromised the quality of the casting, due to higher gas porosity sensitivity. Trial 24 revealed that the bulk hardness of the alloy decreases with decreasing chromium to nickel ratio. In comparing Trials 25 and 26 (chromium to nickel ratio of about 2.13 to 2.18) to Trial 24 (chromium to nickel ratio of about 1.73), bulk hardness decreased from 54.9-57.3 HRC to 25.7 HRC.

In Trials 27-29, the effects of chromium to nickel ratio, carbon content, manganese content and silicon content on bulk hardness and castability were evaluated. The compositions and measured hardness of Trials 27-29 are summarized in TABLE 8.

TABLE 8

| Trial | Heat | C | Mn | Si | Ni | Cr | Mo | Nb | Fe | N | B | Zr | HRC |
|---|---|---|---|---|---|---|---|---|---|---|---|---|---|
| 27 | 6F09XA | 0.355 | 0.124 | 0.579 | 15.18 | 35.86 | 4.001 | 0.911 | 42.68 | 0.034 | 0.003 | 0.016 | 52.2 |
| 28 | 6F12XA | 0.505 | 0.080 | 0.403 | 15.84 | 35.29 | 4.174 | 0.870 | 42.39 | 0.202 | 0.001 | 0.015 | 38.4 |
| 29 | 6F13XA | 0.537 | 0.073 | 0.377 | 16.09 | 35.27 | 4.149 | 0.842 | 42.33 | 0.099 | 0.001 | 0.013 | 39.4 |

Trial 27 illustrates that increasing the chromium to nickel ratio to about 2.36 with about 0.12 weight % manganese and about 0.58 weight % silicon results in a bulk hardness of 52.2 HRC. Trials 28 and 29 illustrate that for chromium to nickel ratio of about 2.22 and lowering manganese and silicon content to 0.08 weight % and 0.4 weight %, respectively, a bulk hardness of 38.4-39.4 HRC was achieved.

In Trials 30-32, the effects of boron content on bulk hardness and castability for an alloy with a target 35Cr-16Ni-4Mo content were evaluated. The compositions and measured hardness of Trials 30-32 are summarized in TABLE 9.

TABLE 9

| Trial | Heat | C | Mn | Si | Ni | Cr | Mo | Nb | Fe | N | B | Zr | HRC |
|---|---|---|---|---|---|---|---|---|---|---|---|---|---|
| 30 | 6F20XA | 0.580 | 0.074 | 0.469 | 15.85 | 35.58 | 4.302 | 0.862 | 41.88 | 0.171 | 0.028 | 0.012 | 38.9 |
| 31 | 6F20XB | 0.538 | 0.067 | 0.381 | 15.84 | 35.80 | 4.297 | 0.879 | 41.66 | 0.270 | 0.213 | 0.012 | 38.0 |
| 32 | 6F22XA | 0.478 | 0.121 | 0.444 | 16.15 | 35.33 | 4.182 | 0.867 | 41.80 | 0.103 | 0.420 | 0.012 | 40.7 |

Trials 30-32 illustrate that as boron content is increased from 0.028 weight % to 0.42 weight %, bulk hardness increased from 38.9 HRC to a 40.7 HRC. Thus, the effects of boron content on bulk hardness are marginal.

In Trials 33-35, the effects of chromium to nickel ratio on bulk hardness were further evaluated. The compositions and measured hardness of Trials 33-35 are summarized in TABLE 10.

TABLE 10

| Trial | Heat | C | Mn | Si | Ni | Cr | Mo | Nb | Fe | N | B | Zr | HRC |
|---|---|---|---|---|---|---|---|---|---|---|---|---|---|
| 33 | 6F23XA | 0.471 | 0.282 | 0.391 | 15.98 | 35.48 | 3.992 | 0.941 | 42.15 | 0.072 | 0.018 | 0.013 | 43.0 |
| 34 | 6F26XA | 0.480 | 0.556 | 0.518 | 16.18 | 35.62 | 4.177 | 0.849 | 41.22 | 0.172 | 0.005 | 0.036 | 39.5 |
| 35 | 6F29XA | 0.544 | 0.132 | 0.481 | 16.21 | 35.53 | 4.131 | 0.846 | 41.67 | 0.072 | 0.412 | 0.036 | 41.6 |

Trials 33-35 illustrate that for optimal hardness and mechanical properties, a chromium to nickel ratio of about 2.20 to about 2.25 is desirable.

In Trials 36-46, the alloy compositions of the J109 alloy were adjusted for optimal castability, casting hardness and to demonstrate repeatability. The compositions and measured hardness of Trials 36-46 are summarized in TABLE 11.

TABLE 11

| Trial | Heat | C | Mn | Si | Ni | Cr | Mo | Nb | Fe | N | B | Zr | HRC |
|---|---|---|---|---|---|---|---|---|---|---|---|---|---|
| 36 | 6G13XA | 0.786 | 0.284 | 0.716 | 16.10 | 32.71 | 3.507 | 0.923 | 44.87 | 0.223 | 0.003 | — | 38.7 |
| 37 | 6G17XA | 0.567 | 0.314 | 0.848 | 15.65 | 34.33 | 4.205 | 0.909 | 42.58 | 0.055 | 0.449 | — | 46.0 |
| 38 | 6H01XA | 0.650 | 0.207 | 0.672 | 15.80 | 33.89 | 3.723 | 0.897 | 43.63 | 0.111 | 0.384 | — | 39.8 |
| 39 | 6H09XA | 0.641 | 0.180 | 0.653 | 16.11 | 34.11 | 3.437 | 0.910 | 43.43 | 0.159 | 0.402 | — | 38.5 |
| 40 | 7B13XA | 0.748 | 0.294 | 0.393 | 16.19 | 33.87 | 4.332 | 0.745 | 43.18 | 0.075 | 0.123 | — | 40.9 |
| 41 | 7F19XA | 0.904 | 0.295 | 0.340 | 15.90 | 33.97 | 4.034 | 0.746 | 43.34 | 0.050 | 0.101 | — | 40.5 |
| 42 | 7G16XA | 0.835 | 0.254 | 0.320 | 16.91 | 33.91 | 4.336 | 0.781 | 42.44 | 0.045 | 0.116 | — | 40.1 |
| 43 | 7G17XA | 0.998 | 0.252 | 0.284 | 16.39 | 33.51 | 4.314 | 0.739 | 43.31 | 0.071 | 0.102 | — | 36.7 |
| 44 | 7I06M | 0.733 | 0.323 | 0.354 | 16.57 | 33.08 | 4.397 | 0.079 | 44.37 | 0.035 | 0.003 | — | 36.0 |
| 45 | 8D02L | 0.746 | 0.251 | 0.404 | 16.90 | 32.56 | 4.374 | 0.669 | 43.92 | 0.052 | 0.077 | — | 36.5 |
| 46 | 8D17K | 0.763 | 0.274 | 0.481 | 16.33 | 33.41 | 4.188 | 0.671 | 43.65 | 0.039 | 0.098 | — | 36.5 |

In Trials 36-40, zirconium was omitted and the compositions of boron and molybdenum were adjusted to achieve an optimal target hardness. Trial 40 illustrates an optimal composition for a target hardness of about 40 HRC.

In Trials 41-43, the concentration of chromium and carbon on hardness of the J109 alloy were evaluated. Trials 44-46 were the final production heats used to cast valve seat insert components.

TABLE 12 provides a summary of the compositional ranges and a preferred compositional range of the J109 alloy, based on the forty-six experimental and production heats (summarized in TABLES 1-11). Incidental impurities in the J109 alloy can include one or more of Al, As, Bi, Cu, Ca, Ce, Co, Hf, Mg, N, P, Pb, S, Sn, Ta, Ti, V, W, Y and Zn. Preferably, a total content of incidental impurities is 1.5 weight % or less. Due to the limitations of some furnace equipment (e.g., open air induction furnace), nitrogen content can be difficult to control. Preferably, the maximum concentration of nitrogen is 0.25 weight %.

TABLE 12

| Element | J109 Alloy Compositional Range (weight %) | J109 Alloy Compositional Preferred Range (weight %) |
|---|---|---|
| C | 0.15 to 0.9 | 0.5 to 0.9 |
| Si | 0.2 to 1.3 | 0.2 to 0.5 |
| Mn | 0.45 maximum | 0.2 to 0.4 |
| Cr | 32.5 to 37.5 | 33.0 to 35.0 |

TABLE 12-continued

| Element | J109 Alloy Compositional Range (weight %) | J109 Alloy Compositional Preferred Range (weight %) |
|---|---|---|
| Ni | 13.5 to 17.5 | 15.5 to 17.5 |
| Mo | 3.2 to 5.5 | 4.0 to 4.5 |
| Nb | 2.0 maximum | 0.7 to 0.9 |

TABLE 12-continued

| Element | J109 Alloy Compositional Range (weight %) | J109 Alloy Compositional Preferred Range (weight %) |
|---|---|---|
| B | 0.5 maximum | 0.07 to 0.13 |
| Zr | 2.0 maximum | 0.05 maximum |
| Fe | 30 to 51 | 40 to 46 |

Evaluation of Microstructure

Figure 2A:
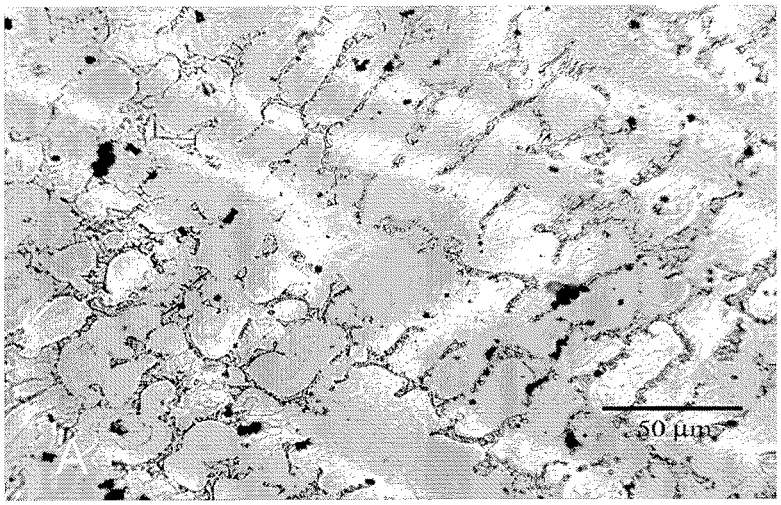
FIGS. 2A-2B are optical micrographs of the J109 alloy in the as-cast condition.
Figure 2B:
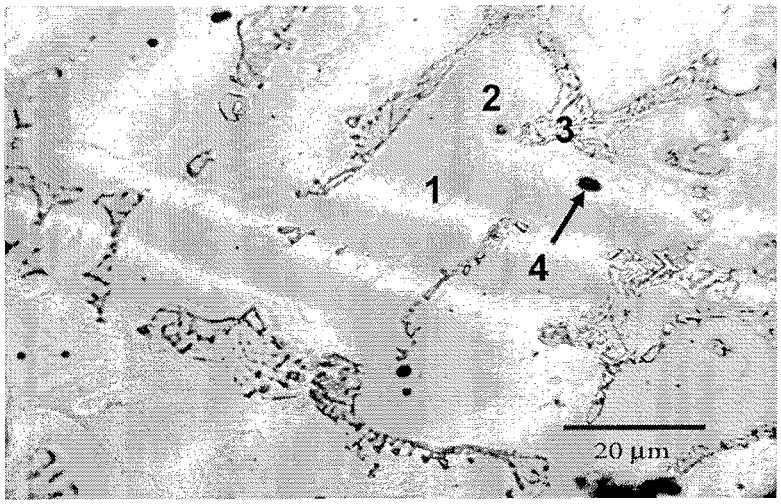

FIGS. 2A and 2B are optical micrographs of an electrolytically etched as-cast J109 alloy (Trial 34 from TABLE 10). The microstructure of the as-cast J109 alloy can be characterized by a dendritic region composed of a chromium-rich austenitic matrix, free of primary carbides with strengthening phases distributed along interdendritic or intergranular regions. Interdendritic regions are composed of nickel-rich eutectic reaction phases. Preferably, the microstructure is also free of iron-chromium a phases after heat treating the alloy at about 650° C. (about 1200° F.) for 20 hours.

FIG. 2B also illustrates several characteristic microstructural features of the J109 alloy. Regions 1 and 2 of FIG. 2B indicate dendritic features in the microstructure of the J109 alloy. Region 3 indicates interdendritic features and Region 4 indicates an oxide inclusion, which is a common microstructural feature of castings. Regions 1 and 2 also indicate evidence of microsegregation or coring through peritectic reaction during solidification.

To reduce solidification shrinkage and cracking, the J109 alloy was designed to undergo eutectic and peritectic reactions during solidification. The J109 alloy can be defined as a Fe—Cr—Ni ternary alloy with a significant amount of molybdenum and optional niobium alloying elements. During cooling, the primary δ-ferrite phase is the first region to solidify (as indicated by Region 1), surrounded by a liquid phase. Upon further cooling, the δ-ferrite phase and liquid phase undergo a peritectic reaction to form γ-austenite (Region 2). Meanwhile, during cooling, the δ-ferrite phase of Region 1 undergoes a solid-state reaction to form γ-austenite. The remaining liquid in the interdendritic regions (Region 3) solidifies into eutectic phases.

Figure 3:
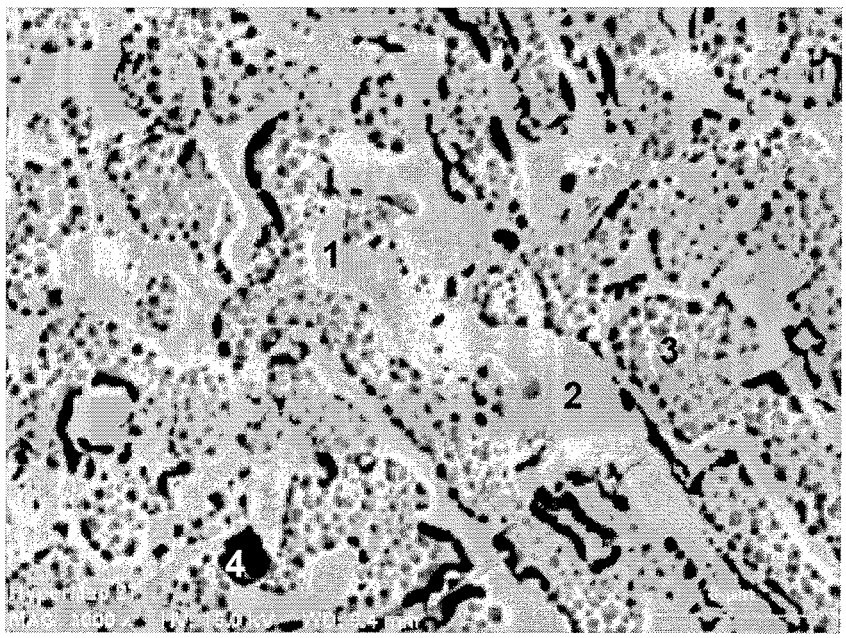
FIG. 3 is a scanning electron microscopy micrograph of the J109 alloy in the as-cast condition.

FIG. 3 is a scanning electron microscopy (SEM) micrograph illustrating an enlarged view of the J109 alloy microstructure, including dendritic features, interdendritic features and oxide inclusions. Each of the features were further characterized by electron dispersive spectroscopy (EDS).

From FIG. 3, Region 1 is a central region of a dendritic feature. An EDS analysis of Region 1 indicates a high chromium content (about 47 weight %) and niobium content (about 4.7 weight %), indicative that Region 1 was the first to solidify as δ-ferrite, which undergoes a solid-state transformation to form γ-austenite. In Region 1, the chromium to nickel ratio is about 5.4. Region 2 is an outer region of a dendritic feature. An EDS analysis of Region 2 indicates that the chromium to nickel ratio is about 3.4. Region 2 is indicative of a solidification mode of the δ-ferrite plus liquid to form austenite. Region 3 is an interdendritic feature containing a high content of nickel (about 19 weight %). Region 3 was likely formed by undergoing a eutectic reaction. Region 4 is an oxide inclusion, which typically exists in castings.

Thermal Expansion Coefficient Testing

Thermal expansion coefficient is an important material property which affects residual stress levels and distribution during thermal cycling between engine heating and cooling. Samples of the J109 alloy from Trial 15 (TABLE 4) were analyzed by dilatometry (Model 1000-D, manufactured by Orton, Westerville, Ohio) to obtain linear thermal expansion coefficient measurements. Testing was carried out in an argon atmosphere from ambient temperature to about 1000° C. For comparative purposes, other valve seat insert alloys, including a cobalt-based alloy (J3 or STELLITE 3®), a nickel-based alloy (J96) and an austenitic stainless steel alloy (J121) were also analyzed by dilatometry. All of the J-Series alloys are available from L.E. Jones Company, located in Menominee, Mich. The dilatometry samples had a cylindrical geometry, about 1 inch in length and about 0.5 inch in diameter. The linear thermal expansion coefficient measurements were conducted perpendicular to the primary directional solidification orientation for these alloys. The results of the dilatometry analysis are summarized in TABLE 13.

TABLE 13

| Temperature (° C.) | Linear Thermal Expansion Coefficient ($\times 10^6$ mm/mm ° C.) J109 (Trial 15) | J3 (Co-based) | J96 (Ni-based) | J121 (austenitic) |
|---|---|---|---|---|
| 25 to 200 | 13.97 | 13.09 | 12.21 | 17.41 |
| 25 to 300 | 14.39 | 13.96 | 12.98 | 18.26 |
| 25 to 400 | 14.72 | 14.54 | 13.42 | 18.85 |
| 25 to 500 | 14.99 | 15.01 | 13.75 | 19.29 |
| 25 to 600 | 15.38 | 15.26 | 14.23 | 19.62 |

As illustrated in TABLE 13, the linear thermal expansion coefficient for the J109 alloy is about 24% to 27% lower than a comparable austenitic stainless steel (i.e., J121). Likewise, the linear thermal expansion coefficient for the J109 alloy was slightly greater (6% to 8%) than a commercially existing cobalt-based alloy (J3 or STELLITE 3®) currently in use as valve seat insert material.

Corrosion Resistance Testing

Samples of the J109 alloy from Trial 11 (Heat 6C09XA), Trial 16 (Heat 6D11XA) and Trial 18 (Heat 6D27XB) were evaluated for corrosion resistance using ASTM G5 (standard reference test method for making potentiostatic and potentiodynamic anodic polarization measurements) and ASTM G61 (standard test method for conducting potentiostatic and potentiodynamic measurements for localized corrosion susceptibility of iron-, nickel- or cobalt-based alloys). The acidified test solution was composed of sodium sulfate (7800 ppm $SO_4^{-2}$) and sodium nitrate (1800 ppm $NO_3^{-1}$). The pH of the solution was adjusted to between about 2.5 and about 3.0 with acetic acid (5 g/L). Test samples were cylindrical (½" in diameter and ⅕" long). The top and bottom surfaces were masked using a silicone coating to isolate the test connections from the test solution. Test samples were degreased with soap and water followed by a methanol rinse prior to exposure in the acidified test solution.

For comparative purposes, other valve seat insert alloys, including a cobalt-based alloy (J3, similar to STELLITE 3®), a nickel-based alloy (J89), iron-based alloys (J121, J133) and martensitic steel (J125, J160, J130, J120V, J149, all available from L.E. Jones Company) were evaluated. TABLE 14 summarizes corrosion test results and the electrochemical test behavior.

TABLE 14

| Alloy | Microstructure | Corrosion (mpy) | Behavior |
|---|---|---|---|
| J109 | Superaustenitic | <0.1 | Passive/Active |
| J3 | Cobalt-based face-centered cubic solid solution and primary carbides | <0.1 | Passive/Active |
| J89 | Nickel-rich eutectic and primary carbides | <0.1 | Passive/Active |
| J133 | Ferrite and carbide | <0.1 | Active |
| J121 | Austenitic | 3 | Passive/Active |
| J125 | Martensitic | 11 | Passive/Active |
| J160 | Martensitic | 65 | Passive/Active |
| J130 | Martensitic | 101 | Active |
| J120V | Martensitic | 263 | Active |
| J149 | Martensitic | >500 | Active |

As illustrated in TABLE 14, the J109 alloy exhibited excellent corrosion resistance, comparable to the cobalt-based alloy (J3 or STELLITE 3), the nickel-rich J89 alloy or the iron-based J133 alloy. Furthermore, the J109 alloy exhibited a substantial improvement over martensitic steels (J125, J160, J130, J120V, J149) and the J121 austenitic stainless steel.

Pitting Corrosion Resistance

Pitting corrosion resistance for stainless steel can be theoretically predicted using a criteria known as "pitting resistance equivalent number" or "PREN" value. PREN values can be determined based on alloy composition using the following relation:

$$PREN=\%\ Cr+3.3\%\ Mo+30\%\ N,$$

where chromium, molybdenum and nitrogen are in weight %. Stainless steel with a PREN value of greater than 45, preferably, greater than 50 exhibit excellent pitting corrosion resistance.

For valve seat insert applications, it has been determined that silicon content can influence PREN value. At L. E. Jones Company, the standard PREN values have been modified to account for silicon content using the following relation:

$$PREN_{LEJ}=\%\ Cr+3.3\%\ Mo+30\%\ N-15\%\ Si,$$

where chromium, molybdenum, nitrogen and silicon are in weight %. TABLE 15 tabulates standard PREN and modified $PREN_{LEJ}$ values for the J109 alloy in comparison to other commonly used stainless steel.

TABLE 15

| Alloy | PREN | $PREN_{LEJ}$ | Microstucture |
|---|---|---|---|
| J109 | 52.9 | 52.2 | Superaustenitic |
| J133 | 51.3 | 48.3 | Ferritic |
| J130 | 47.4 | 46.5 | Martensitic |
| AL-6XN ® | 45.8 | 45.8 | Superaustenitic |
| J160 | 44.8 | 44.1 | Martensitic |
| AISI-SAE No. 904L | 34.9 | 34.9 | Superaustenitic |
| J125 | 29.9 | 26.5 | Martensitic |
| Alloy 20 | 28.3 | 28.3 | Superaustenitic |
| J120V | 25.8 | 25.1 | Martensitic |
| J121 | 26.1 | 24.9 | Austenitic |
| AISI-SAE No 316 (Cast) | 24.3 | 24.1 | Austenitic |
| AISI-SAE No. 304 (Cast) | 18 | 17.9 | Austenitic |
| AISI-SAE No. 347 (Cast) | 18 | 17.9 | Austenitic |

Compression and Tension Testing

Samples of the J109 alloy (Trial 15, Heat 6C29XB) with the composition outlined in TABLE 4 were evaluated to determine compression strength and tensile strength for temperatures up to 1000° F. using ASTM E8-04 (2004) (standard test methods for tension testing of metallic materials) and ASTM E21-05 (standard test for ultimate tensile rupture strength). Results of this testing are summarized in TABLE 16.

TABLE 16

| | Ambient | | 600° F. | | 800° F. | | 1000° F. | |
|---|---|---|---|---|---|---|---|---|
| | Tension | Comp. | Tension | Comp. | Tension | Comp. | Tension | Comp. |
| Yield Strength (0.01%) (ksi) | 56.0 | — | 32 | — | 33 | — | 34.0 | — |
| Yield Strength (0.2%) (ksi) | — | 95.2 | — | 82.7 | — | 73.8 | — | 79.4 |
| Elastic Modulus (msi) | 28.4 | 27.8 | 21.0 | 18.6 | 20.9 | 16.2 | 21.8 | 15.5 |
| Ultimate Tensile Strength (ksi) | 62.3 | — | 45.9 | — | 56.8 | — | 52.7 | — |

For compression strength testing, the J109 alloy was similar to cobalt-based alloy J6 (similar to STELLITE-6®). For tensile strength testing, the J109 alloy exceeded conventional nickel-based alloys J96 and J100 (similar to EATONITE®). These tests have determined that the J109 alloy possesses sufficient mechanical strength for valve seat insert applications.

Wear Resistance Evaluation

Wear testing of valve-train alloys conducted on a Plint Model TE77 Tribometer can accurately predict wear resistance under simulated service conductions during testing in diesel and natural gas engines. Samples of J109 alloy were evaluated for wear resistance up to 500° C. using ASTM G133-95 (standard test method for determining sliding wear of wear-resistant materials using a linearly reciprocating ball-on-flat geometry). High temperature reciprocating wear tests were carried out using a reciprocating pin versus plate test. The testing conditions included a 20 N applied load, a 20 Hz reciprocating frequency and a 1 mm stroke length at eight test temperatures from 25° C. to 500° C. (i.e., 25° C., 200° C., 250° C., 300° C., 350° C., 400° C., 450° C. and 500° C.) for 100,000 cycles. All tests were conducted in the laboratory ambient atmosphere with dry test conditions (i.e., no lubrication).

In the wear tests, the reciprocating pin was made of the valve seat insert material (e.g., J109 alloy), while the stationary plate was made of the valve material. The J109 alloy from Trial 32 (Heat 6F22XA) was tested. As a comparison, a cobalt-based alloy (i.e., J3, similar to STELLITE-3®), a nickel-based alloy (i.e., J100), a nickel-rich alloy (i.e., J73) and iron-based alloys (i.e., J130, J160) for the reciprocating pin were also tested.

The valve materials tested included: (1) a hard-facing alloy (P37, available from TRW Automotive, similar to STELLITE-F®); (2) a high temperature nickel-based superalloy (i.e., INCONEL-751®); and (3) an high-chromium iron-based valve material (i.e., CROMO-193®). The results of Plint wear testing are summarized in TABLES 17A-17D.

TABLE 17A

| Materials Test Pairs | | | | | | | | | |
|---|---|---|---|---|---|---|---|---|---|
| Temp | J109/P37 Wear (mg) | | | J3/P37 Wear (mg) | | | J100/P37 Wear (mg) | | |
| (° C.) | Plate | Pin | Total | Plate | Pin | Total | Plate | Pin | Total |
| 25 | 0.70 | 1.50 | 2.20 | 0.10 | 0.1 | 0.20 | 1 | 0.4 | 1.40 |
| 200 | 5.60 | 9.20 | 14.80 | 0.10 | 2.5 | 2.60 | 1.1 | 2.7 | 3.80 |

TABLE 17A-continued

| Temp | Materials Test Pairs J109/P37 Wear (mg) | | | J3/P37 Wear (mg) | | | J100/P37 Wear (mg) | | |
|---|---|---|---|---|---|---|---|---|---|
| (° C.) | Plate | Pin | Total | Plate | Pin | Total | Plate | Pin | Total |
| 250 | 6.60 | 4.40 | 11.00 | 0.40 | 2.4 | 2.80 | 2.3 | 2.2 | 4.50 |
| 300 | 3.70 | 1.20 | 4.90 | 0.50 | 2.3 | 2.80 | 2.3 | 1.9 | 4.20 |
| 350 | 6.60 | 2.10 | 8.70 | 1.10 | 2.4 | 3.50 | 3 | 0.5 | 3.50 |
| 400 | 1.90 | 1.20 | 3.10 | 0.40 | 4 | 4.40 | 0.7 | 0.3 | 1.00 |
| 450 | 0.80 | 0.30 | 1.10 | 1.10 | 2.4 | 3.50 | 0.7 | 0.3 | 1.00 |
| 500 | 0.90 | 0.00 | 0.90 | 0.80 | 1.9 | 2.70 | 0.6 | 0.3 | 0.90 |

TABLE 17B

| Temp | Materials Test Pairs J130/P37 Wear (mg) | | | J160/P37 Wear (mg) | | |
|---|---|---|---|---|---|---|
| (° C.) | Plate | Pin | Total | Plate | Pin | Total |
| 25 | 3 | 1.4 | 4.4 | 3.1 | 0.1 | 3.2 |
| 200 | 4.7 | 1.8 | 6.5 | 2.8 | 0.6 | 3.4 |
| 250 | 4 | 3.1 | 7.1 | 3.5 | 1.1 | 4.6 |
| 300 | 4.1 | 2.6 | 6.7 | 3.3 | 1.6 | 4.9 |
| 350 | 0.6 | 1.5 | 2.1 | 1 | 1.8 | 2.8 |
| 400 | 0.2 | 1 | 1.2 | 1.1 | 1.5 | 2.6 |
| 450 | 0 | 0.1 | 0.1 | — | — | — |
| 500 | 0 | 0.1 | 0.1 | 0.3 | 0 | 0.3 |

In TABLE 17A, the J109 alloy from Trial 15 (Heat 6C29XB) (reduced B and Zr content with about 0.13 weight % Mn for enhanced wear resistance) was tested. As illustrated in TABLE 17A, for J109/P37 materials pair, at 25° C. material loss was relatively low (2.2 mg). Likewise, at higher test temperatures from 400° C. to 500° C., material loss was also relatively low (≦3.1 mg). However, at a medium test temperature from 200° C. to 350° C., material loss was high (8.7 mg to 11 mg). At a temperature of less than 250° C., more wear occurs on the pin; at a temperature of greater than 250° C., more wear occurs on the plate.

As illustrated in TABLES 17A-17B, wear data for J3/P37, J100/P37, J130/P37 and J160/P37 materials pairs are summarized. In comparing the five materials pairs, the J109/P37 materials system exhibited higher wear at medium test temperature from 200° C. to 250° C. (11 mg to 14.8 mg). However, the J109/P37 materials system (total wear of 0.9 mg to 3.1 mg) outperformed the J3/P37 materials pair (total wear of 2.7 mg to 4.4 mg) at a higher test temperature of 400° C. to 500° C.

TABLE 17C

| Temp | Materials Test Pairs J109/INCONEL-751 ® Wear (mg) | | | J73/INCONEL-751 ® Wear (mg) | | | J3/INCONEL-751 ® Wear (mg) | | |
|---|---|---|---|---|---|---|---|---|---|
| (° C.) | Plate | Pin | Total | Plate | Pin | Total | Plate | Pin | Total |
| 25 | 2.5 | 1.4 | 3.9 | 2.2 | 0.7 | 2.9 | 2.5 | 0.4 | 2.9 |
| 200 | 2.1 | 0.4 | 2.5 | 2.2 | 1 | 3.2 | 0.6 | 1.1 | 1.7 |
| 250 | 1.4 | 0.1 | 1.5 | 1.8 | 0.2 | 2 | 0.8 | 2.9 | 3.7 |
| 300 | 1.5 | 0.3 | 1.8 | 1.3 | 0.4 | 1.7 | 1.1 | 3.1 | 4.2 |
| 350 | 1.2 | 0 | 1.2 | 1.2 | 0 | 1.2 | 0.8 | 3.8 | 4.6 |
| 400 | 2.2 | 0 | 2.2 | 2.3 | 0 | 2.3 | 0 | 1.6 | 1.6 |
| 450 | 1.8 | 0 | 1.8 | 2 | 0 | 2 | 2.4 | 0 | 2.4 |
| 500 | 1.5 | 0 | 1.5 | 1.1 | 0 | 1.1 | 2.5 | 0 | 2.5 |

TABLE 17D

| Temp | Materials Test Pairs J109/CROMO-193 ® Wear (mg) | | | J160/CROMO-193 ® Wear (mg) | | | J130/CROMO-193 ® Wear (mg) | | |
|---|---|---|---|---|---|---|---|---|---|
| (° C.) | Plate | Pin | Total | Plate | Pin | Total | Plate | Pin | Total |
| 25 | 1.50 | 2.70 | 4.20 | 0.90 | 1.40 | 2.30 | 1.3 | 2.2 | 3.50 |
| 200 | 2.30 | 0.60 | 2.90 | 1.40 | 1.40 | 2.80 | 0.6 | 0.1 | 0.70 |
| 250 | 1.00 | 0.10 | 1.10 | 0.10 | 1.10 | 1.20 | 1.1 | 0.8 | 1.90 |
| 300 | 0.40 | 0.00 | 0.40 | 0.60 | 1.00 | 1.60 | 0.1 | 1.3 | 1.40 |
| 350 | 0.60 | 0.20 | 0.80 | 0.00 | 1.20 | 1.20 | 0.1 | 0.7 | 0.80 |
| 400 | 0.20 | 0.10 | 0.30 | 0.00 | 1.20 | 1.20 | 0.1 | 0.3 | 0.40 |
| 450 | 0.30 | 0.20 | 0.50 | 2.10 | 0.80 | 2.90 | 0.4 | 1.5 | 1.90 |
| 500 | 0.00 | 0.00 | 0.00 | 0.20 | 1.10 | 1.30 | 1.2 | 1.4 | 2.60 |

As illustrated in TABLES 17C-17D, the J109/INCONEL-751® materials pair was tested. Additionally, J73/INCONEL-751®, J109/INCONEL-7510 and J3/INCONEL-7519 materials pairs were also tested. From TABLE 17C, the J109 alloy outperformed J3 (cobalt-based) especially for test temperatures exceeding 200° C.

As illustrated in TABLE 17D, the J109/CROMO-193®materials pair was tested. Additionally, J160/CROMO-193® and J130/CROMO-193® materials pairs were also tested. From TABLE 17D, the J109 alloy outperformed J130 and J160 (martensitic steel) especially for test temperatures exceeding about 250° C.

Dimensional Stability Testing

Samples of the J109 alloy with the composition from Trial 8 (Heat 6B21XA), Trial 13 (Heat 6C16XA), Trial 15 (Heat 6C29XA), Trial 36 (Heat 6G25XA) and Trial 37 (Heat 7B13XA) were evaluated for crystallographic stability by measuring the dimensional changes of the sample valve seat inserts before and after exposure to an elevated temperature. The outer diameters (O.D.) of the valve seat insert samples were measured at two locations, spaced 180° apart (i.e., 0°-180° orientation and 90°-270° orientation). The maximum allowable change in O.D. size after heating is $0.3\times10^{-3}$ inches per inch of outside diameter. Valve seat insert samples tested in TABLE 18 had a 1.87 inch O.D. size thus allowing for a maximum $0.56\times10^{-3}$ inch change in O.D. size. The results of the crystallographic stability testing are summarized in TABLE 18.

The valve seat insert samples were heated to about 650° C. (about 1200° F.) for 20 hours in a lab type electrical furnace. To eliminate oxidation on the surfaces of the valve seat insert samples, all samples were placed in a titanium coated stainless steel thin foil bag during heating.

TABLE 18

| Heat No. | Pre-Aging Hardness (HRC) | Post-Aging Hardness (HRC) | Size Change (in × $10^{-3}$) 0°-180° | 90°-270° | Average Size Change on 1.87" O.D. (in. × $10^{-3}$) (0.56 Allowable) | Status (Pass/Fail) |
|---|---|---|---|---|---|---|
| 8 | 55.6 | 54.7 | 0.4 | 0.2 | 0.3 | Pass |
| | 56.0 | 54.9 | 0.4 | 0.2 | 0.3 | Pass |
| | 56.2 | 55.1 | 0.3 | 0.4 | 0.35 | Pass |
| | 56.4 | 54.4 | 0.1 | 0.7 | 0.4 | Pass |
| | 55.9 | 54.8 | 0 | 0.4 | 0.2 | Pass |
| 13 | 36.8 | 37.6 | 0.1 | 0 | 0.05 | Pass |
| | 38.0 | 39.3 | 0.1 | 0.1 | 0.1 | Pass |
| | 37.3 | 40.0 | 0 | 0.5 | 0.25 | Pass |
| | 36.6 | 37.4 | 0.2 | 0.3 | 0.25 | Pass |

TABLE 18-continued

| Heat No. | Pre-Aging Hardness (HRC) | Post-Aging Hardness (HRC) | Size Change (in × $10^{-3}$) 0°-180° | Size Change (in × $10^{-3}$) 90°-270° | Average Size Change on 1.87" O.D. (in. × $10^{-3}$) (0.56 Allowable) | Status (Pass/Fail) |
|---|---|---|---|---|---|---|
| | 38.2 | 38.4 | 0 | 0.2 | 0.1 | Pass |
| 15 | 38.8 | 39.1 | 0.5 | 0.2 | 0.35 | Pass |
| | 39.8 | 39.9 | 0.5 | 0.5 | 0.5 | Pass |
| | 39.2 | 39.0 | 0.5 | 0.4 | 0.45 | Pass |
| | 38.5 | 38.9 | 0.5 | 0.4 | 0.45 | Pass |
| | 38.7 | 40.1 | 0.4 | 0.5 | 0.45 | Pass |
| 36 | 41.6 | 40.8 | 0.1 | 0 | 0.05 | Pass |
| | 40.7 | 40.2 | 0 | 0.1 | 0.05 | Pass |
| | 40.0 | 41.0 | 0.1 | 0.2 | 0.15 | Pass |
| | 40.9 | 41.7 | 0 | 0 | 0 | Pass |
| | 39.7 | 41.7 | 0 | 0 | 0 | Pass |
| 37 | 41.2 | 41.8 | 0 | 0.1 | 0.05 | Pass |
| | 41.5 | 41.5 | 0 | 0.3 | 0.15 | Pass |
| | 41.1 | 41.2 | 0.2 | 0.1 | 0.15 | Pass |
| | 41.1 | 41.0 | 0.1 | 0.1 | 0.1 | Pass |
| | 41.2 | 41.2 | 0.1 | 0.2 | 0.15 | Pass |

From the dimensional stability test, it was determined that valve seat insert samples with O.D.'s of 1.87 inches were crystallographically stable after being heated at 1200° F. for 20 hours. For certain applications, the valve seat insert samples should not undergo precipitation hardening (i.e., a significant precipitation of σ-iron-chromium phase with a tetragonal crystal structure should be avoided). The formation of sigma phase can reduce the toughness of the valve seat insert, resulting in a brittle component. It has been determined that the formation of a σ-iron-chromium phase can be suppressed by selecting a manganese content effective produce a microstructure free of σ-iron-chromium tetragonal precipitates (e.g., limiting the manganese content to ≦0.45 weight %).

Hot Hardness Evaluation

Samples of the J109 alloy were evaluated for hot hardness at temperatures up to 1600° F. (871° C.) with the Vickers hardness testing technique using ASTM E92-82 (2003) (standard test method for Vickers hardness of metallic materials). For comparative purposes, other iron-based alloys including J121 (austenitic stainless steel), J133 (ferrite and carbide-type duplex heat-resistant steel), J120V (martensitic tool steel) and J130 (Cr—Mo heat- and wear-resistant steel) alloys were also tested for hot hardness. Test samples were inserted into three different testing locations in a vacuum chamber, which was evacuated to a pressure of $10^{-5}$ Torr prior to heating. Three Vickers hardness impressions were made in each sample using a diamond pyramid indenter with a 10 kg load at about room temperature. In a vacuum environment, the 10 kg load was corrected by 885 grams, due to the additional load imparted by the vacuum, for a total load of 10.885 kg. The test samples were successively heated to 200° F., 400° F., 600° F., 800° F., 1000° F., 1400° F. and 1600° F. After the temperature was stabilized at each temperature, three impressions were made on each sample, for a total of nine impressions at each temperature. The results of the hot hardness test are summarized in TABLE 19.

TABLE 19

| Temp° F.(° C.) | Vickers Hardness (HV10) J109 | J121 | J133 | J120V | J130 |
|---|---|---|---|---|---|
| 68 (20) | 419 | 219 | 475 | 536 | 580 |
| 200 (93) | 429 | 258 | 425 | 530 | 569 |
| 400 (204) | 386 | 234 | 420 | 493 | 568 |
| 600 (316) | 367 | 215 | 417 | 465 | 530 |
| 800 (427) | 350 | 207 | 380 | 416 | 492 |
| 1000 (538) | 335 | 192 | 300 | 344 | 445 |
| 1200 (649) | 294 | 172 | 180 | 209 | 373 |
| 1400 (760) | 213 | 147 | 120 | 104 | 240 |
| 1600 (871) | 120 | 96 | 55 | 103 | 134 |

From the hot hardness testing, the J109 alloy exhibited considerable hardness enhancement in comparison to J121 (austenitic stainless steel) for the entire temperature range. The J109 alloy also exhibited slightly greater hot hardness than J120V (martensitic tool steel) at temperatures greater than 1000° F. (538° C.). At test temperatures exceeding 1000° F. (538° C.), only the J130 alloy (Cr—Mo heat- and wear-resistant steel) exhibited greater hot hardness properties than the J109 alloy.

Preferably, the insert exhibits a decrease in hardness of 25% or less when heated from about room temperature to about 1000° F. For example, from TABLE 19, the insert exhibits an HV10 Vickers hardness from at least about 420 HV10 at about room temperature to at least about 335 HV10 at about 1000° F.

In another embodiment, the J109 alloy can be formed into a shaped component by powder metallurgy. For example, metal powders of the superaustenitic stainless steel can be pressed into a green shaped component and sintered at temperatures from about 1950° F. to about 2300° F., preferably about 2050° F. The shaped component is preferably sintered in a reducing atmosphere. For example, the reducing atmosphere can be hydrogen or a mixture of nitrogen and dissociated ammonia.

Heat Treatment and Crush Testing of Castings

The J109 alloy from Test 42 (Heat 7G16XA) was cast into valve seat inserts and subjected to one or more optional post-casting heat treatment at a temperature from about 900° F. to about 1700° F. from about 3 hours to about 15 hours. Nine different heat treatments were tested for five valve seat insert samples (i.e., a total of forty-five valve seat insert samples). Each valve seat insert sample was tested for bulk hardness before and after the post-casting heat treatment. For each valve seat insert, bulk hardness testing was repeated three times. The results are summarized in TABLE 20.

TABLE 20

| Heat Treatment | Hardness (HRC) As-Cast | Post-Heat Treatment | Change |
|---|---|---|---|
| 1000° F. for 15 hours | 39.5 | 39.2 | 0.3 |
| 1700° F. for 2 hours; and 1300° F. for 3 hours | 39.3 | 43.6 | 4.3 |
| 1300° F. for 15 hours | 38.9 | 39.1 | 0.2 |
| 1500° F. for 2 hours; and 1300° F. for 3 hours | 39.1 | 39.6 | 0.5 |
| 1550° F. for 4 hours | 39.7 | 41.6 | 1.9 |
| 1300° F. for 4 hours | 38.9 | 39.1 | 0.2 |
| 1100° F. for 4 hours | 39.3 | 39.4 | 0.1 |
| 1000° F. for 4 hours | 39.3 | 39.4 | 0.1 |
| 900° F. for 4 hours | 39.2 | 39.6 | 0.4 |

As illustrated in TABLE 20, hardness of the as-cast valve seat insert can be increased over 4% by heat treating at 1550° F. to 1700° F. Higher hardness can be beneficial in producing valve seat inserts with greater wear resistance. This increase in hardness is likely due to the formation of precipitates during the heat treatment (e.g., precipitation hardening).

The heat treatment can be carried out in an inert, oxidizing, or reducing atmosphere (e.g., nitrogen, argon, air or nitrogen-hydrogen mixture), or in a vacuum. The temperature and time of the heat treatment can be varied to optimize the hardness and/or strength of the J109 alloy.

Each as-cast and heat treated valve seat insert was subjected to radial crush testing in ambient conditions to evaluate toughness. Crush testing was evaluated according to a modified version of the Metal Powder Industry Federation Standard 55 (determination of radial crush strength of powder metallurgy test specimens). A compressive load was applied to each valve seat insert in the radial orientation. The peak force and deformation at rupture obtained from radial crush testing is summarized in TABLE 21. The peak force and deflection data is an average value of three samples.

TABLE 21

| Heat Treatment | Peak Force (lbs.) | Total Deflection (in.) | Toughness Index (in.-lbs./100) |
|---|---|---|---|
| None (as-cast) | 1088 | 0.0293 | 0.319 |
| 1000° F. for 15 hours | 829 | 0.0247 | 0.205 |
| 1700° F. for 2 hours; and 1300° F. for 3 hours | 1005 | 0.0281 | 0.282 |
| 1300° F. for 15 hours | 1095 | 0.0279 | 0.305 |
| 1500° F. for 2 hours; and 1300° F. for 3 hours | 1175 | 0.0295 | 0.347 |
| 1550° F. for 4 hours | 1131 | 0.0304 | 0.344 |
| 1300° F. for 4 hours | 1029 | 0.0297 | 0.306 |
| 1100° F. for 4 hours | 1037 | 0.0295 | 0.306 |
| 1000° F. for 4 hours | 873 | 0.0275 | 0.240 |
| 900° F. for 4 hours | 960 | 0.0306 | 0.294 |

From TABLE 21, it was determined that a heat treatment of the shaped component (e.g., valve seat insert) can be adjusted to produce a toughness index of the shaped component after heat treating that is lower than a toughness index of the shaped component before heat treating. Increased toughness is beneficial for machining of shaped components, due to improved crack resistance in grinding operations.

The preferred embodiments are merely illustrative and should not be considered restrictive in any way. For example, while the superaustenitic stainless steel is especially suited for valve seat inserts, other shaped components can include furnace components, engine components, rollers, bearings, bushings, biocompatible components, welding filler material for stainless steel welding, corrosion-resistant material for chemical or petrochemical applications, or the like. The scope of the invention is given by the appended claims, rather than the preceding description, and all variations and equivalents which fall within the range of the claims are intended to be embraced therein.

What is claimed is:

1. A superaustenitic stainless steel comprising, in weight %:

0.15 to 0.9% C;
0.2 to 1.3% Si;
0 to 0.45% Mn;
32.5 to 37.5% Cr;
13.5 to 17.5% Ni;
3.2 to 5.5% Mo;
0 to 2% Nb;
0 to 0.5% B;
0 to 2% Zr; and
30 to 51% Fe.

2. The superaustenitic stainless steel of claim 1, consisting essentially of 0.5 to 0.9% C, 0.2 to 0.5% Si, 0.2 to 0.4% Mn, 33.0 to 35.0% Cr, 15.5 to 17.5% Ni, 4.0 to 4.5% Mo, 0.7 to 0.9% Nb, 0.07 to 0.13% B, 0 to 0.05% Zr and 40 to 46% Fe.

3. The superaustenitic stainless steel of claim 1, further comprising incidental impurities of one or more of Al, As, Bi, Cu, Ca, Ce, Co, Hf, Mg, N, P, Pb, S, Sn, Ta, Ti, V, W, Y and Zn with a total content of incidental impurities of 1.5 weight % or less.

4. The superaustenitic stainless steel of claim 1, having a microstructure with an austenitic matrix free of primary carbides, ferrite and/or martensite, the microstructure having strengthening phases distributed along interdendritic regions or intergranular regions.

5. The superaustenitic stainless steel of claim 1, having a microstructure with intergranular or dendritic regions comprising an austenitic matrix; and interdendritic regions comprising eutectic reaction phases.

6. The superaustenitic stainless steel of claim 5, wherein the austenitic matrix is rich in Cr; the eutectic reaction phases are rich in Ni; and/or the austenitic matrix contains precipitates of niobium carbide and/or niobium carbonitride.

7. The superaustenitic stainless steel of claim 1, wherein C is 0.5 to 0.9%.

8. A valve seat insert comprising in weight %:

0.15 to 0.9% C;
0.2 to 1.3% Si;
0 to 0.45% Mn;
32.5 to 37.5% Cr;
13.5 to 17.5% Ni;
3.2 to 5.5% Mo;
0 to 2% Nb;
0 to 0.5% B;
0 to 2% Zr; and
30 to 51% Fe.

9. The valve seat insert of claim 8, consisting essentially of 0.5 to 0.9% C, 0.2 to 0.5% Si, 0.2 to 0.4% Mn, 33.0 to 35.0% Cr, 15.5 to 17.5% Ni, 4.0 to 4.5% Mo, 0.7 to 0.9% Nb, 0.07 to 0.13% B, 0 to 0.05% Zr and 40 to 46% Fe.

10. The valve seat insert of claim 8, wherein the insert is a casting.

11. The valve seat insert of claim 8, wherein the insert has a hardness from about 35 to about 45 Rockwell C, a compressive yield strength from about 80 ksi to about 100 ksi at about room temperature; and/or a compressive yield strength from about 60 ksi to about 80 ksi at 1000° F.

12. The valve seat insert of claim 8, wherein the insert has an ultimate tensile rupture strength from about 50 ksi to about 70 ksi at about room temperature; and/or an ultimate tensile rupture strength from about 40 ksi to about 60 ksi at about 1000° F.

13. The valve seat insert of claim 8, wherein the insert exhibits a dimensional stability of less than about $0.3\times10^{-3}$ inches per inch of insert outside diameter (O.D.) after heating for about 20 hours at about 1200° F.; and wherein the weight % Mn is present in an amount effective to produce a microstructure free of σ-iron-chromium tetragonal precipitates, martensite phases and/or ferrite phases after heating the insert to about 20 hours at about 1200° F.

14. The valve seat insert of claim 8, wherein:

(a) the insert exhibits an HV10 Vickers hardness from about 420 HV10 at about room temperature to about 335 HV10 at about 1000° F.; or (b) the insert exhibits a decrease in hardness of 25% or less when heated from about room temperature to about 1000° F.

15. A method of manufacturing an internal combustion engine comprising inserting the valve seat insert of claim 8 in a cylinder head of the internal combustion engine.

16. The method of claim 15, wherein the engine is a diesel or natural gas engine.

17. A method of operating an internal combustion engine comprising closing a valve against the valve seat insert of claim 8 to close a cylinder of the internal combustion engine and igniting fuel in the cylinder to operate the internal combustion engine.

18. The method of claim 17, wherein the valve:

(i) is a high-chromium iron-based alloy or a high-temperature, nickel-based superalloy;

(ii) the valve is hard-faced with a high temperature, wear-resistant alloy strengthened by carbides.

19. The valve seat of claim 8, wherein C is 0.5 to 0.9%.

20. A method of making a superaustenitic stainless steel, comprising in weight %:

0.15 to 0.9% C;
0.2 to 1.3% Si;
0 to 0.45% Mn;
32.5 to 37.5% Cr;
13.5 to 17.5% Ni;
3.2 to 5.5% Mo;
0 to 2% Nb;
0 to 0.5% B;
0 to 2% Zr; and
30 to 51% Fe;

wherein:

(a) the superaustenitic stainless steel is cast into a shaped component from a melt at a temperature from about 2800° F. to about 3000° F.; or (b) a powder of the superaustenitic stainless steel is pressed into a shaped component and sintered at a temperature from about 1950° F. to about 2300° F. in a reducing atmosphere, wherein the reducing atmosphere is hydrogen or a mixture of dissociated ammonia and nitrogen.

21. The method of claim 20, wherein the shaped component is a valve seat insert and the superaustenitic stainless steel consists essentially of 0.5 to 0.9% C, 0.2 to 0.5% Si, 0.2 to 0.4% Mn, 33.0 to 35.0% Cr, 15.5 to 17.5% Ni, 4.0 to 4.5% Mo, 0.7 to 0.9% Nb, 0.07 to 0.13% B, 0 to 0.05% Zr and 40 to 46% Fe.

22. The method of claim 20, further comprising precipitation hardening by heat treating the shaped component at a temperature from about 900° F. to about 1700° F. for about 2 hours to about 15 hours; and the heat treating is performed in an inert, oxidizing, or reducing atmosphere, or in a vacuum such that a hardness of the shaped component after heat treating is greater than a hardness of the shaped component before heat treating.

* * * * *